US007121895B2

(12) United States Patent
Shiga

(10) Patent No.: US 7,121,895 B2
(45) Date of Patent: Oct. 17, 2006

(54) ELECTRICAL CONNECTOR HAVING CONTACT RECEIVING CAVITIES LOCATED IN RIBS

(75) Inventor: Katsumi Shiga, Chiba (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/115,428

(22) Filed: Apr. 27, 2005

(65) Prior Publication Data

US 2005/0239337 A1 Oct. 27, 2005

(30) Foreign Application Priority Data

Apr. 27, 2004 (JP) ..... 2004-131978

(51) Int. Cl.
*H01R 24/00* (2006.01)

(52) U.S. Cl. ..... 439/660

(58) Field of Classification Search ..... 439/660, 439/680, 674, 677
See application file for complete search history.

(56) References Cited

U.S. PATENT DOCUMENTS 5,254,010 A * 10/1993 Davis ..... 439/108
5,575,685 A 11/1996 Ittah et al.
5,785,539 A 7/1998 Ham et al.
6,371,811 B1 * 4/2002 Chen et al. ..... 439/607
6,482,045 B1 * 11/2002 Arai ..... 439/680
6,830,485 B1 * 12/2004 Koehler et al. ..... 439/660

FOREIGN PATENT DOCUMENTS

JP 04-206483 7/1992

* cited by examiner

*Primary Examiner*—Tho D. Ta
*Assistant Examiner*—Vanessa Girardi
(74) *Attorney, Agent, or Firm*—Barley Snyder LLC

(57) ABSTRACT

The present invention provides a female connector that can simplify the process of attaching male contacts by eliminating the need for the process of removing some of male contacts. The female connector has a female housing with recessed mating sections for receiving mating male connectors. A plurality of rows of male contacts protrude from the respective bottom surfaces of the recessed mating sections of the female housing to the interior portions of the recessed mating sections. Ribs protrude from the respective bottom surfaces of the recessed mating sections to the interior portions of the recessed mating sections with the protruding length from these bottom surfaces being greater than that of the male contacts. The ribs are provided in areas where the male contacts are arranged, and male contact receiving cavities that receive some of the male contacts are formed in the ribs.

9 Claims, 7 Drawing Sheets

ELECTRICAL CONNECTOR HAVING CONTACT RECEIVING CAVITIES LOCATED IN RIBS

FIELD OF THE INVENTION

The present invention relates to a female connector for mating with a mating male connector and for electrically connecting this mating male connector to a circuit board and the like.

BACKGROUND

A female electrical connector in which male contacts are attached to a female housing has conventionally been known. Such a female electrical connector is designed to mate with a mating male electrical connector in which female contacts are attached to a male housing so that this mating male electrical connector is electrically connected to a circuit board and the like. To be concise, the female electrical connector will herein after be referred to as a female connector and the male electrical connector will hereinafter be referred as a male connector.

The female connector shown in FIGS. 8A and 8B (see Japanese Patent Application Kokai No. H4-206483), for example, has been known as a conventional female connector of this type.

This female connector 101 comprises a female housing 110 which has a plurality of recessed mating sections 110*a* through 110*d* that receive mating male connectors (not shown in the figure), and a plurality of rows of male contacts 120 which protrude from the bottom surfaces of the recessed mating sections 110*a* through 110*d* to the interior of these recessed mating sections 110*a* through 110*d*. Each of the male contacts 120 has a tine 121 that protrudes from the female housing 110 in the opposite direction from the recessed mating sections 110*a* through 110*d*, and these tines 121 are connected to a circuit board (not shown in the figure).

Furthermore, the female housing 110 is provided with a plurality of ribs 111 which protrude from the respective bottom surfaces of the recessed mating sections 110*a* through 110*d* to the interior portions of these recessed mating sections 110*a* through 110*d*. As is shown in FIG. 8B, the ribs 111 extend from the respective bottom surfaces of the recessed mating sections 110*a* through 110*d* to the same plane as the front end surface (right end surface in FIG. 8B) of the female housing 110, so that the protruding length from these bottom surfaces is greater than that of the male contacts 120 which protrude to the interior of the respective recessed mating sections 110*a* through 110*d*. Accordingly, when an attempt is made to insert mating male connectors diagonally into the female connector 101, the mating male connectors always contact the female housing 110 and ribs 111 before contacting the tips of the male contacts 120. As a result, there is no damage or deformation of the tips of the male contacts 120 when the mating male connectors are inserted into the female connector 101.

However, in this conventional female connector 101, there is no male contact 120 disposed in the areas where the ribs 111 are disposed as shown in FIG. 8A. The attachment of the male contacts 120 to the female housing 110 is generally accomplished by attaching a group of the male contacts 120 of each row by driving these male contacts in from the rear of the female housing 110. In the female connector 101, however, since the areas where the ribs 111 are disposed have no male contact 120 disposed therein, it is necessary to have a process of removing the male contacts 120 in the areas where the ribs 111 are disposed. Furthermore, the removed male contacts 120 are commonly discarded.

SUMMARY

Accordingly, the present invention was devised in light of the problems described above. It is an object, among others, of the present invention to provide a female connector that can simplify the process of attaching male contacts by eliminating any need for the male contact removal process.

The female connector of the present invention has a female housing with recessed mating sections for receiving mating male connectors. A plurality of rows of male contacts protrude from the bottom surfaces of the recessed mating sections of the female housing to the interior portions of the recessed mating sections. Ribs protrude from the bottom surfaces of the recessed mating sections to the interior portions of the recessed mating sections, with this length of protrusion from the bottom surfaces being greater than that of the male contacts. The ribs are formed in areas where the male contacts are arranged, and male contact receiving cavities that receive some of the male contacts are formed in the ribs.

In the female connector of the present invention, since the ribs are formed in areas where the male contacts are arranged, and since male contact receiving cavities that receive some of the male contacts are formed in these ribs, there is no need to remove the male contacts in the areas where the ribs are provided, which makes it possible to simplify the contact attachment process. Furthermore, since some of the male contacts are received in the male contact receiving cavities in the ribs, the ribs can be reinforced by these male contacts.

DETAILED DESCRIPTION OF THE EMBODIMENTS

Figure 1:
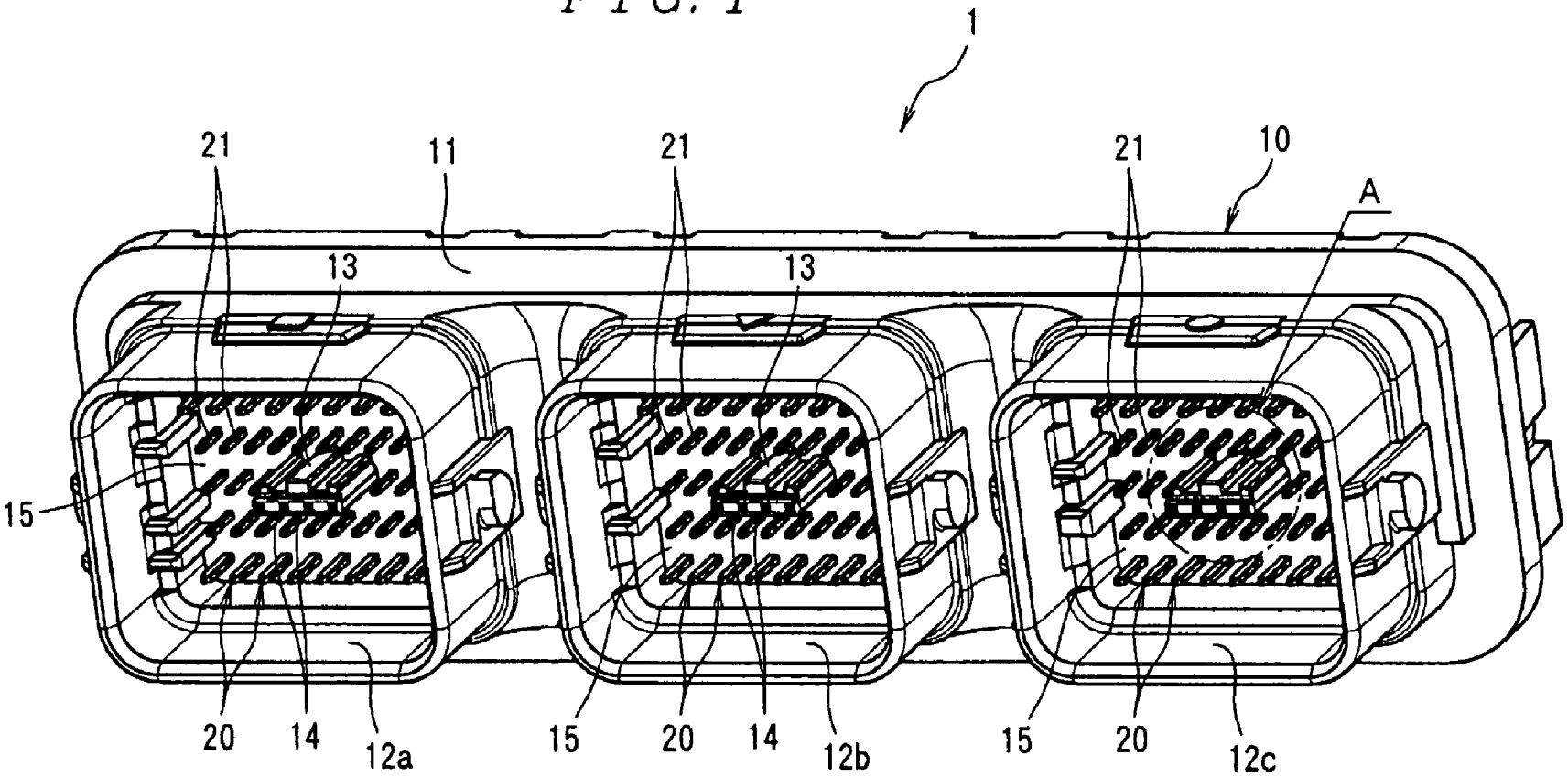
FIG. 1 is a perspective view of the female connector of the present invention.

Next, an embodiment of the present invention will be described with reference to the figures. In FIGS. 1 through 7, the female connector 1 comprises a female housing 10 and a plurality of male contacts 20. Here, the female housing 10 comprises a substantially rectangular shaped base 11 having a length extending in the left-right direction of FIG. 1, and a plurality of recessed mating sections 12*a*, 12*b* and 12*c* (three recessed mating sections in the present embodiment) that protrude forward (to the left in FIG. 7) from the base 11. The individual recessed mating sections 12*a*, 12*b* and 12*c* respectively receive mating male connectors C (see FIG. 4), and are disposed at a specified pitch along the length. In the present embodiment, the respective recessed mating sections 12*a*, 12*b* and 12*c* are formed with a substantially rectangular external shape to conform to the external shape of the mating male connectors C. The female housing 10 is formed by molding an insulative material.

Furthermore, the male contacts 20 are arranged in a plurality of rows (five rows in the present embodiment) in each of the recessed mating sections 12*a*, 12*b* and 12*c*. Each male contact 20 comprises a contact section 21 that is formed with a pin shape having sides and a tip and that protrudes from the bottom surface 15 of one of the respective recessed mating sections 12*a*, 12*b* and 12*c* to the interior portion of this mating recessed part 12*a* 12*b* or 12*c*, and a tine 22 (see FIG. 4) that extends from the contact section 21 in the opposite direction from the recessed mating sections 12*a* 12*b* and 12*c*. Each male contact 20 is formed by stamping and forming a conductive material. The contact sections 21 of the respective male contacts 20 electrically contact female contacts (not shown in the figures) formed on the mating male connectors C, while the tines 22 are connected to a circuit board.

Moreover, the female housing 10 is provided with a plurality of ribs 13 one in each recessed mating sections 12*a*, 12*b*, 12*c*, with a total of three ribs 13 in the present embodiment that protrude from the respective bottom surfaces 15 of the recessed mating sections 12*a*, 12*b* and 12*c* to the interior portions of the recessed mating sections 12*a*, 12*b* and 12*c*. As is shown most clearly in FIGS. 4 and 7, the ribs 13 extend from the respective bottom surfaces 15 of the recessed mating sections 12*a*, 12*b* and 12*c* to substantially central portions of the recessed mating sections 12*a*, 12*b* and 12*c*, and the length of protrusion from the bottom surfaces 15 is greater than that of the contact sections 21 of the male contacts 20, which protrude to the interior of the respective recessed mating sections 12*a*, 12*b* and 12*c*. Accordingly, when an attempt is made to insert the mating male connectors C diagonally into the female connector 1, the mating male connectors C always contacts the female housing 10 and ribs 13 before contacting the tips of the contact sections 21. Consequently, there is no damage or deformation of the tips of the contact sections 21 of the male contacts 20 when the mating male connectors C are inserted into the female connector 1.

Figure 2:
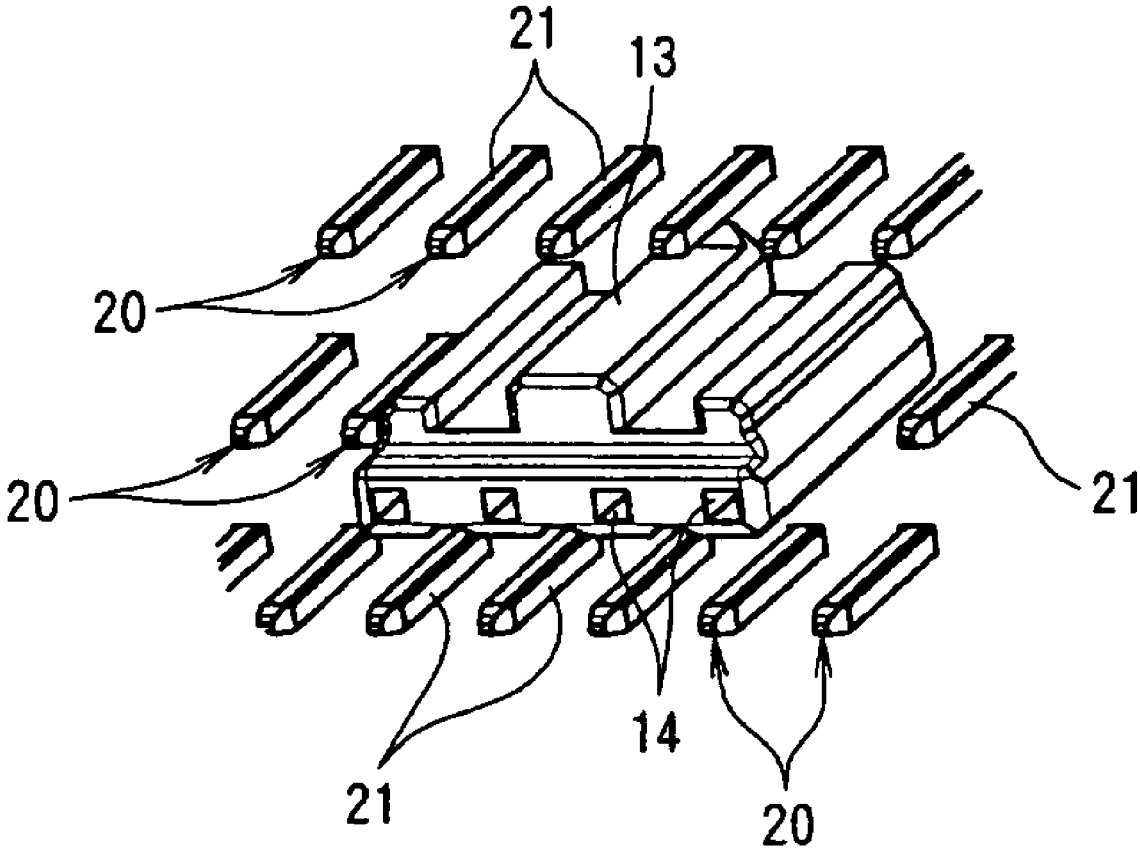
FIG. 2 is an enlarged perspective view of the encircled portion indicated by the arrow A in FIG. 1.
Figure 3:
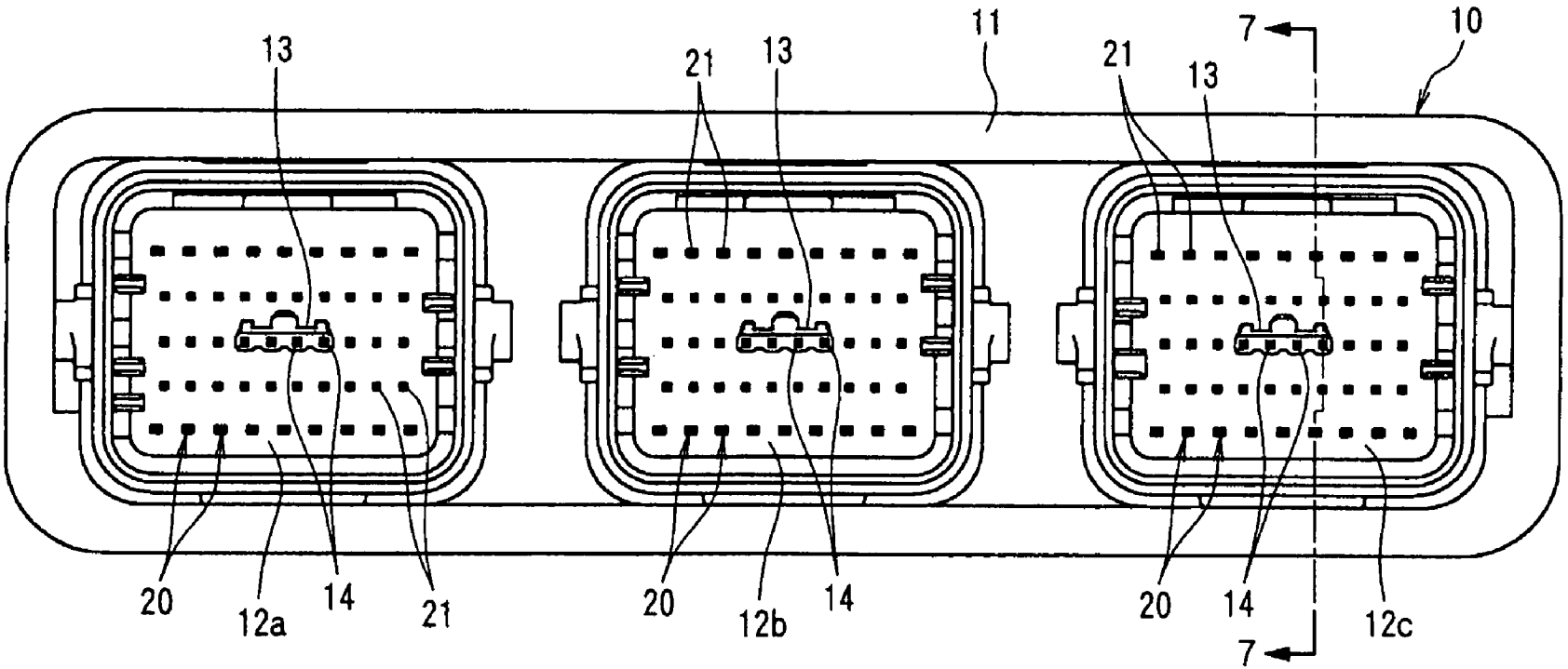
FIG. 3 is a front view of the female connector shown in FIG. 1.
Figure 4:
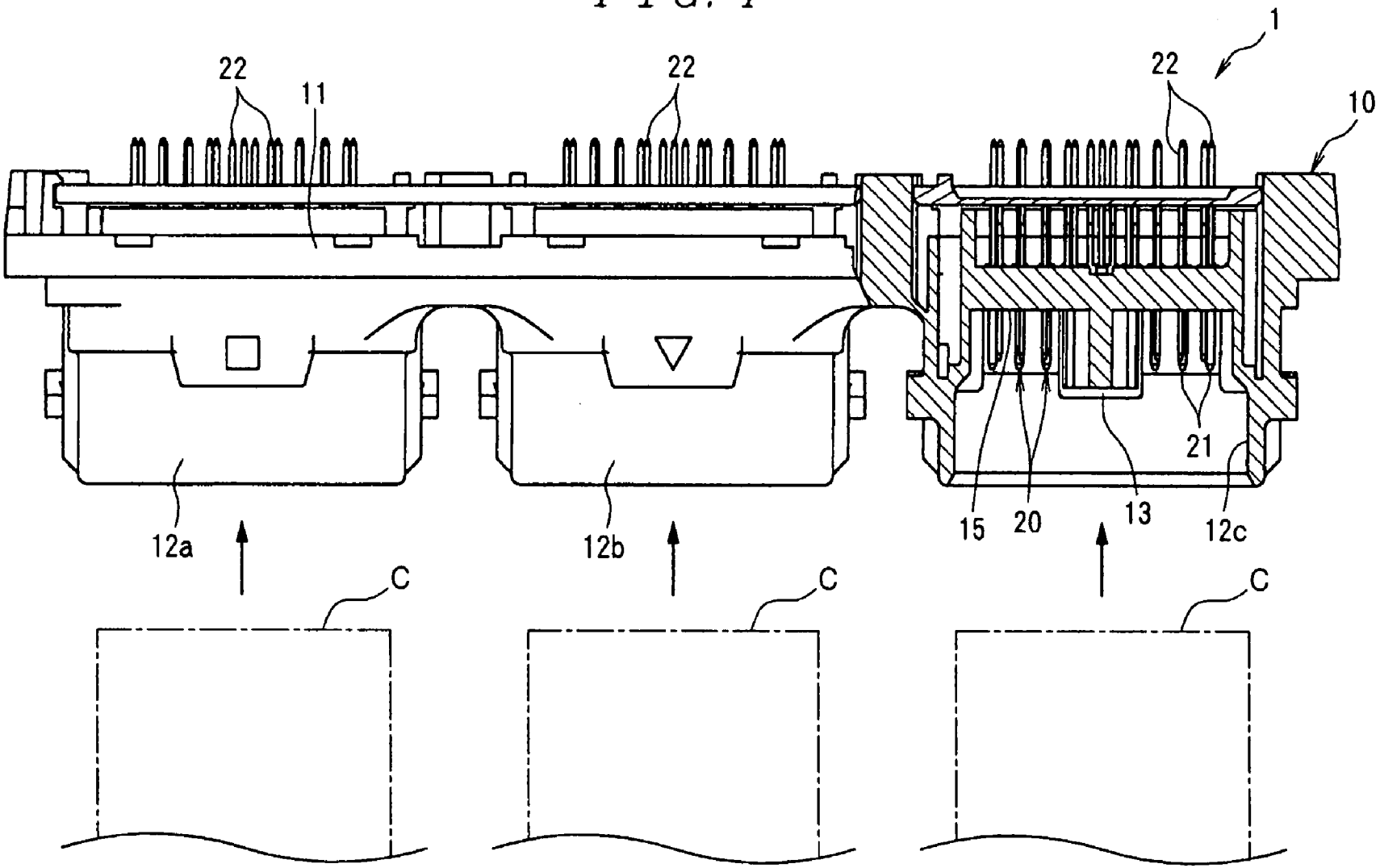
FIG. 4 is a plan view with a partial cross-section of the female connector shown in FIG. 1.
Figure 5:
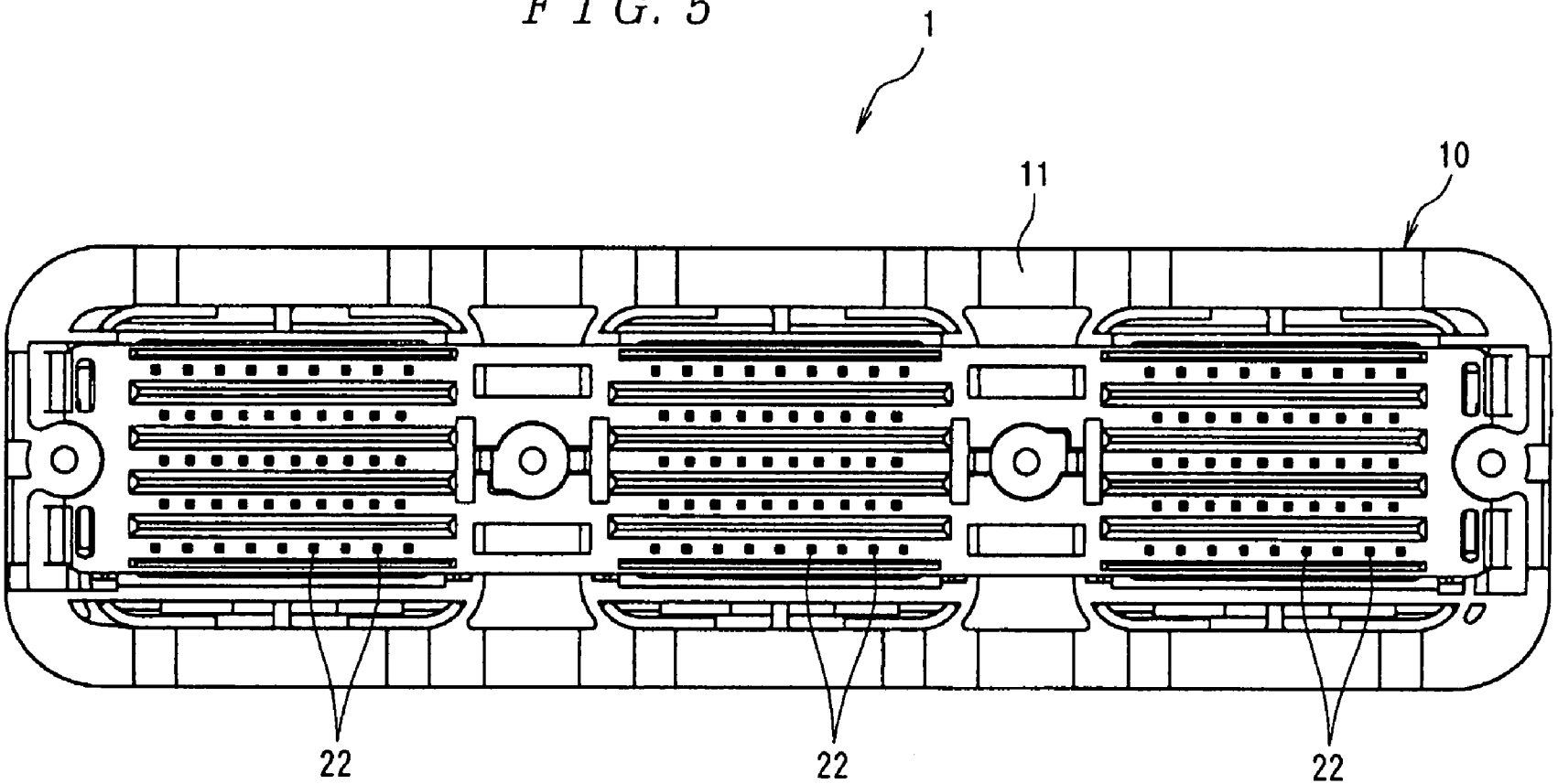
FIG. 5 is a back view of the female connector shown in FIG. 1.
Figure 6:
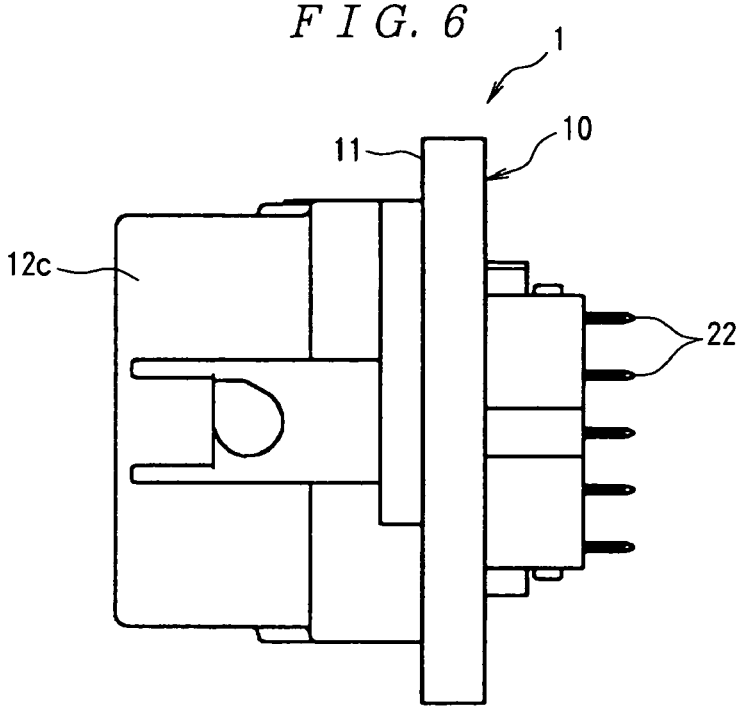
FIG. 6 is a right-side view of the female connector shown in FIG. 1.
Figure 7:
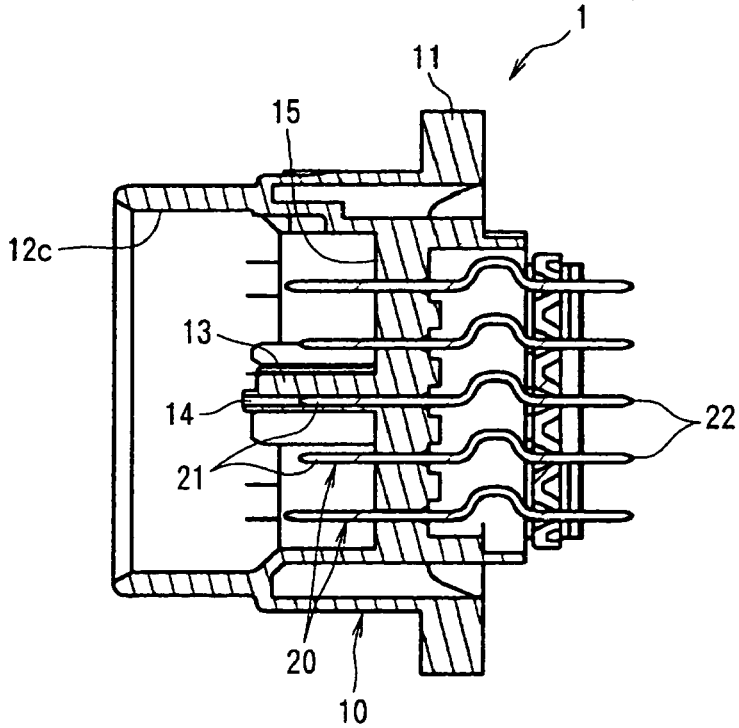
FIG. 7 is a sectional view along line 7—7 in FIG. 3.
Figure 8A:
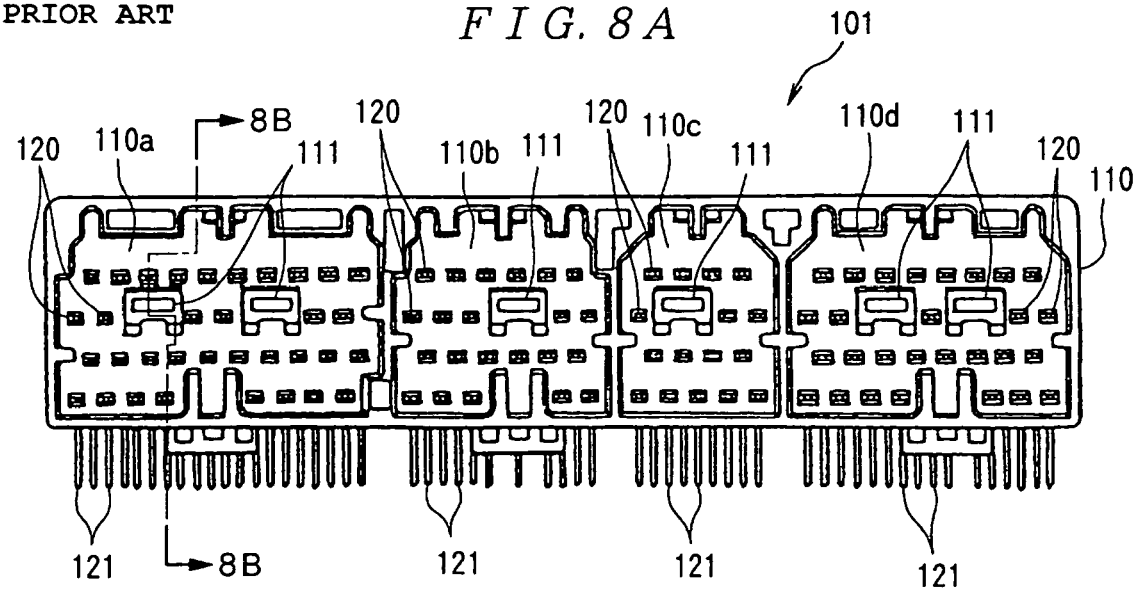
PRIOR ART FIG. 8A
FIGS. 8A and 8B show conventional examples of a female connector, with FIG. 8A being a front view, and FIG. 8B being a sectional view along line 8B—8B in FIG. 8A.
Figure 8B:
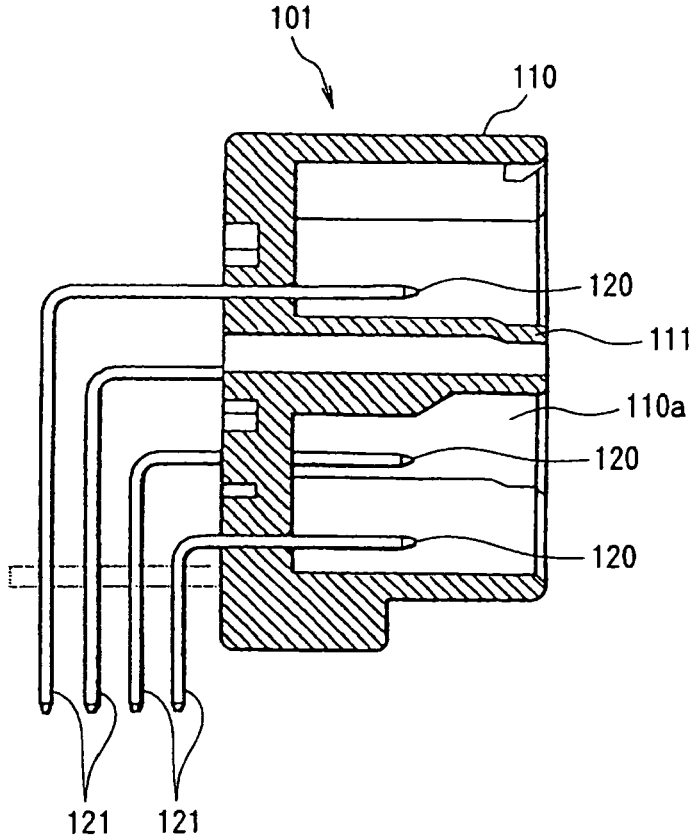
FIG. 8B PRIOR ART

Furthermore, as is shown most clearly in FIGS. 1, 2 and 3, the respective ribs 13 are formed with a substantially rectangular shape that extends along the length, and are provided in areas where the contact sections 21 of the male contacts 20 are arranged. In the present embodiment, the respective ribs 13 are provided on the contact sections 21 of the male contacts 20 of the third row from the top. Moreover, a plurality of male contact receiving cavities 14 (four cavities in the present embodiment) that receive the contact sections 21 of the male contacts 20 are formed in each of the ribs 13, and some of the contact sections 21 among the contact sections 21 of the male contacts 20 of the third row are received in the male contact receiving cavities 14 such that the contact receiving cavities 14 are surrounding the sides of the contact sections 21 as shown most clearly in FIG. 7. Note that FIG. 7 only shows a state in which the contact sections 21 within the mating recessed part 12*c* are received.

Here, the attachment of the male contacts 20 to the female housing 10 is accomplished by attaching a group of the male contacts 20 in each row by driving these male contacts 20 in from the rear of the female housing 10. In the present embodiment, the ribs 13 are provided in areas where the contact sections 21 of the male contacts 20 are arranged, and the male contact receiving cavities 14 that receive the contact sections 21 of some of the male contacts 20 are formed in each of the ribs 13. Accordingly, it is not necessary to remove the male contacts 20 in the areas where the ribs 13 are formed, and the male contacts 20 of the row in the area where each rib 13 is provided can also be attached by driving these male contacts 20 in from the rear of the female housing 10 in the same manner as in the male contacts 20 of the other rows. Accordingly, the contact attachment process can be simplified compared to the conventional connectors.

Furthermore, since the contact sections 21 of some of the male contacts 20 are received in the male contact receiving cavities 14 in the ribs 13, the ribs 13 can be reinforced by the contact parts 21 of these male contacts 20.

The tines 22 of the male contacts 20 are connected to the circuit board, and the mating male connectors C are inserted into the recessed mating sections 12*a*, 12*b* and 12*c* of the female connector 1, thus mating the mating male connectors C with the female connector 1. As a result, the female contacts of the mating male connectors C contact the contact sections 21 of the male contacts 20 of the female connector 1, so that the female contacts of the mating male connectors C and the circuit board are electrically connected. Furthermore, when the mating of the mating male connectors C and the female connector 1 is released, the electrical connection between the female contacts of the mating male connectors C and the circuit board is released.

An embodiment of the present invention was described above. However, the present invention is not limited to this embodiment, and various alterations and modifications can be made.

For example, it is not necessary to form a plurality of recessed mating sections 12*a*, 12*b* and 12*c*, and a single recessed mating section may be formed.

Furthermore, these recessed mating sections do not always have to be formed with a substantially rectangular shape. Other shapes are anticipated and it is sufficient that the external shape of the recessed mating sections 12*a*, 12*b* and 12*c* conforms to the external shape of the mating male connectors C.

Moreover, although the male contacts 20 are arranged in a plurality of rows in each of the recessed mating sections 12*a*, 12*b* and 12*c*, the number of the rows is not always limited to five.

Furthermore, the number of the ribs 13 is not limited to one in each of the recessed mating sections 12*a*, 12*b* and 12*c*. It would also be possible to provide a plurality of ribs in each of the recessed mating sections 12*a*, 12*b* and 12*c*.

Moreover, it is not necessary to form each rib 13 on the contact sections 21 of the male contacts 20 of the third row from the top in each of the recessed mating sections 12*a*, 12*b* and 12*c*. It would also be possible to form each rib 13 on the contact sections 21 of another row as long as the ribs 13 are formed in areas where the contact parts 21 of the male contacts 20 are arranged.

In addition, the number of the male contact receiving cavities 14 formed in each rib 13 does not have to be plural, a singular cavity may also be formed.

What is claimed is:

1. A female connector comprising:

a female housing having a plurality of recessed mating sections for receiving mating male connectors;

each recessed mating section comprises;

a plurality of rows of male contacts that protrude into the recessed mating section from a bottom surface of the recessed mating section, each male contact having a contact section located in the recessed mating section; and a rib that protrudes into the recessed mating section from the bottom surface, said rib protruding a length that exceeds the protrusion of the male contacts, the rib occupies an area where the male contacts are arranged and, male contact receiving cavities formed in the rib surround the contact sections.

2. The female connector of claim 1 wherein the contact sections of the male contacts we positioned inside the male contact receiving cavities.

3. The female connector of claim 2 wherein the tips of the contact sections are positioned inside the male contact receiving cavities.

4. The female connector of claim 3 wherein the male contacts further comprise tines extending opposite the recessed mating section for connection to a circuit board.

5. An electrical connector comprising:

a housing having a base supporting a bottom surface and a recessed mating section;

a rib extending from the bottom surface;

a male contact receiving cavity formed in the rib; and, a male contact having a contact section extending into the recessed mating section from the bottom surface, the contact section being surrounded by the male contact receiving cavity.

6. The electrical connector of claim 5 wherein the male contact further comprises a tine extending opposite the recessed mating section for connection to a circuit board.

7. The electrical connector of claim 5 wherein the housing is a female housing having a recessed mating section.

8. The electrical connector of claim 7 wherein the rib is located in the recessed mating section.

9. The electrical connector of claim 8 wherein a male connector is receivable within the recessed mating section such that the male connector engages the rib before engaging the male contacts upon mating.

* * * * *

UNITED STATES PATENT AND TRADEMARK OFFICE

CERTIFICATE OF CORRECTION

PATENT NO. : 7,121,895 B2
APPLICATION NO. : 11/115428
DATED : October 17, 2006
INVENTOR(S) : Katsumi Shiga It is certified that error appears in the above-identified patent and that said Letters Patent is hereby corrected as shown below:

In column 6, line 4, "male contacts we positioned" should read -- male contacts are positioned --.

Signed and Sealed this

Seventeenth Day of April, 2007

JON W. DUDAS
*Director of the United States Patent and Trademark Office*